US010850884B1

(12) United States Patent
Bar et al.

(10) Patent No.: US 10,850,884 B1
(45) Date of Patent: Dec. 1, 2020

(54) METHOD AND APPARATUS FOR DEBRIS COLLECTION AND HAULING

(71) Applicants: Nir Bar, Marietta, GA (US); Oren Bar, Marietta, GA (US)

(72) Inventors: Nir Bar, Marietta, GA (US); Oren Bar, Marietta, GA (US)

( * ) Notice: Subject to any disclaimer, the term of this patent is extended or adjusted under 35 U.S.C. 154(b) by 0 days.

(21) Appl. No.: 16/165,327

(22) Filed: Oct. 19, 2018

Related U.S. Application Data

(60) Provisional application No. 62/574,783, filed on Oct. 20, 2017.

(51) Int. Cl.
*B65B 67/12* (2006.01)
*B65F 1/14* (2006.01)

(52) U.S. Cl.
CPC ..... *B65B 67/1205* (2013.01); *B65B 67/1238* (2013.01); *B65F 1/1415* (2013.01); *B65F 1/1452* (2013.01); *B65F 2240/138* (2013.01)

(58) Field of Classification Search
CPC ..... B65B 7/1205; B65B 7/671238; B65F 1/1415; B65F 1/1452; B65F 2240/138
See application file for complete search history.

(56) References Cited

U.S. PATENT DOCUMENTS 4,101,232 A * 7/1978 Haapala ..... A21C 15/002 403/261
2012/0110959 A1* 5/2012 Serago, Jr. ..... B65B 67/1205 53/467

* cited by examiner

*Primary Examiner* — Craig M Schneider
*Assistant Examiner* — Jason K Niesz
(74) *Attorney, Agent, or Firm* — Ted M. Anthony

(57) ABSTRACT

A debris collection assembly can be alternatively configured to form: (i) a chute or bag holder and/or (ii) a bag hauler that can be utilized with conventional bags. The debris collection assembly can be formed from at least one planar member that can be selectively folded or otherwise configured to form a chute apparatus that can serve as a guide for directing loose debris into a bag. The planar member of the debris collection assembly can be removed from the bag and selectively reconfigured to form a hauler for selectively transporting a bag and its contents of desired distances.

9 Claims, 7 Drawing Sheets

METHOD AND APPARATUS FOR DEBRIS COLLECTION AND HAULING

CROSS REFERENCES TO RELATED APPLICATION

This Application claims priority of U.S. Provisional Patent Application Ser. No. 62/574,783, filed Oct. 20, 2017, incorporated herein by reference.

STATEMENTS AS TO THE RIGHTS TO THE INVENTION MADE UNDER FEDERALLY SPONSORED RESEARCH AND DEVELOPMENT

None

BACKGROUND OF THE PRESENT INVENTION

1. Field of the Invention

The present invention pertains to a debris collection assembly for use in collection and handling of loose debris. More particularly, the present invention pertains to a debris collection assembly for use during outdoor work, such as, for example, in connection with the collection and disposal of leaf, grass, yard waste or other loose materials. More particularly still, the present invention pertains to a debris chute and leaf hauler assembly for use during loading and hauling different types of debris in an easier and more efficient manner.

2. Description of Related Art

Conventional bag loading devices help facilitate the loading of loose debris, such as yard waste and the like, into a bag. Generally, such devices support a bag in an upright position, while frequently also holding said bag in an open position to permit loading of debris or other loose materials into said bag. In certain cases, said conventional bag holding devices comprise chute-like structures that can be inserted into a bag in order to hold said bag in an upright, open position.

Said conventional bag loading devices can be effective at holding a bag in an upright and open position in order to permit loading of said bag. However, once said bag has been loaded, it is frequently difficult to pick up and/or move said loaded bag to a different disposal location. Such disposal location, which is typically near a curb, driveway or public street, is often a debris pickup or collection point that can be located some distance away from the bag loading location(s).

Dragging a loaded bag across the ground or other support surface is generally not a good option because of the risk of the bag ripping or tearing; in such instances, the contents of the bag can spill out, thereby creating a new mess that must picked up all over again. Further, lifting a loaded bag is generally not a good option for most users because a full bag can be relatively heavy (weighing forty pounds or more). This can be particularly problematic for weaker persons and/or those who have physical limitations or disabilities.

Thus, there is a need for a debris loading device capable of supporting a bag in an upright position, while simultaneously holding said bag in an open position to permit loading of debris or other loose materials into the bag. Further, the bag loading device should permit the safe and efficient transportation of a full and/or loaded bag from a first location to a second (distant) location, while maintaining the integrity of said loaded bag.

SUMMARY OF THE INVENTION

In a preferred embodiment, the present invention comprises a debris collection assembly. Said debris collection assembly can be alternatively configured to form: (i) a chute or bag holder and/or (ii) a bag hauler. Said debris collection assembly can be utilized with conventional bags constructed from plastic material, cardboard or paper material, or any other similar material; although other bags can be used without departing from the scope of the present invention, in a preferred embodiment the present invention can be used with conventional plastic and/or paper bags that can be used to collect yard debris for disposal or recycling purposes.

In a preferred embodiment, the debris collection assembly of the present invention comprises at least one planar member. Said at least one planar member can be constructed of corrugated plastic material, cardboard or other material having desired characteristics. Said at least one planar member can be configured to create a chute apparatus having a central body and a plurality of side panels that can be, at least partially, received within a bag. Said chute further comprises an end section that extends outwardly from said bag in order to form a funnel-like guide for directing yard waste or other loose debris into an opening of said bag.

In a preferred embodiment, a portion of said chute (formed from said planar member) can be received within a bag in order to support said bag and hold said bag in an open configuration. Said chute can further comprise at least one aperture defining hand grip(s) that enable a user to easily remove said chute from said bag. Said end portion of said planar member extends in a substantially outward direction from said bag, thereby forming a funnel-like guide surface to direct any debris (such as, for example, leaves or grass clippings) into said chute and, eventually, into said bag. As a result, said chute allows for debris to be easily loaded within said bag.

In a preferred embodiment, said debris collection assembly can further be selectively reconfigured—quickly, easily and without specialized tools or skills—to create a hauler apparatus. Although said debris collection assembly can be reconfigured at essentially any time, it is typically altered to form a hauler apparatus after said chute configuration has been utilized to load a bag with yard waste or other loose debris. Following such reconfiguration, said hauler apparatus can be used to transport said loaded bag to a different (sometimes distant) location such as a collection point.

In order to reconfigure said planar member from said chute configuration to said hauler configuration, said end portion of said planar member is attached together to form a base or containment section. Said attachment can be facilitated via a twist-turn lock, or other desirable and temporary attachment means, such as, for example, a pin and clip lock, a rope and wedge mechanism, a rope and spring clamp mechanism, and/or cutting and folding said planar member to form a locking mechanism. Following such reconfiguration, said debris collection assembly can be beneficially utilized as yard waste and debris hauler. Additionally, in said hauler configuration, at least one aperture or opening can be provided to define a hand grip, thereby allowing a user to easily grip and drag said hauler to a desired collection point.

A loaded bag can be moved onto said hauler, and the hauler can then be tipped and dragged to a desired collection point. In a preferred embodiment, at least one skid member is provided to contact the ground or other underlying surface; said at least one skid member can be manufactured from a substantially hard and/or rigid plastic and/or rubber material. Said at least one skid member provides strength and durability to said debris collection assembly when used in said hauler configuration, and beneficially will not mark an underlying surface (such as, for example, a driveway or road). After a loaded bag has been transported to a desired location or collection point, said loaded bag can then be easily moved off of the debris collection assembly. When not in use, the debris collection assembly of the present invention can be quickly and easily reconfigured (unlocked) for convenient handling and storage.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
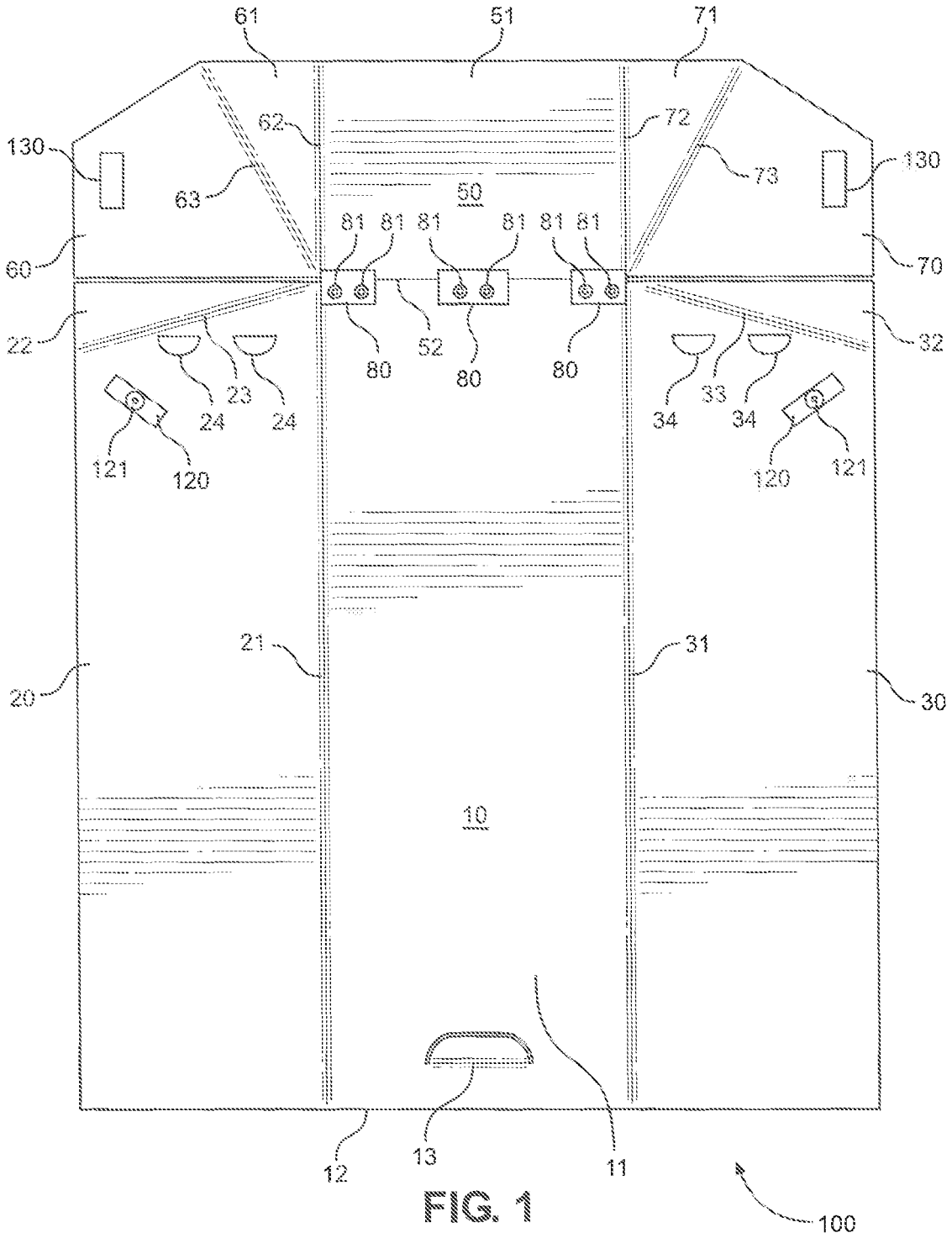
FIG. 1 depicts a rear view of a debris collection assembly of the present invention in an unfolded configuration.
Figure 2:
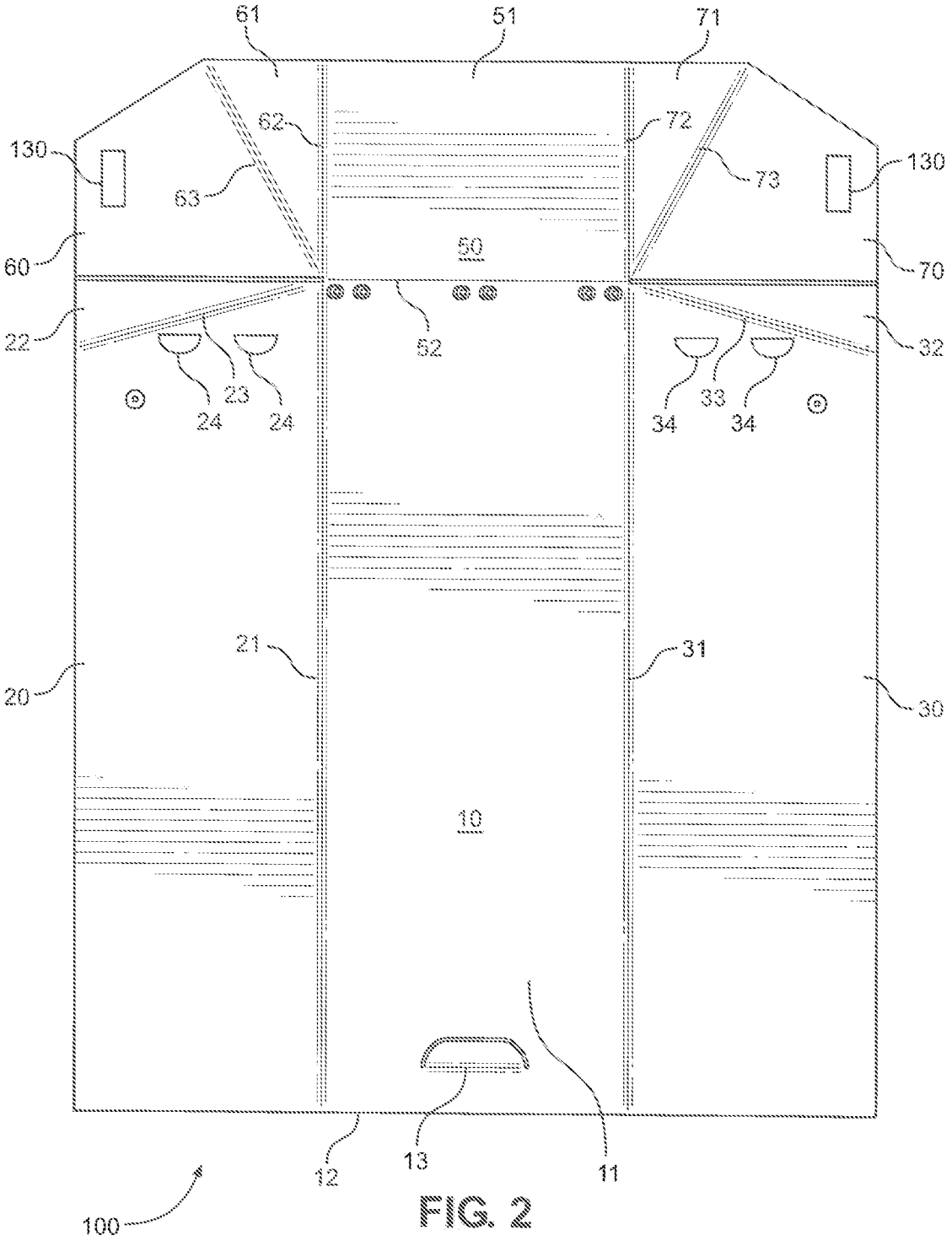
FIG. 2 depicts a front view of a debris collection assembly of the present invention in an unfolded configuration.

FIG. 1 depicts a rear view of debris collection assembly 100 of the present invention in an "unfolded" or flattened configuration, while FIG. 2 depicts a front view of said debris collection assembly 100 of the present invention in said "unfolded" or flattened configuration. It is to be observed that the views depicted in FIGS. 1 and 2 are rotated approximately 180 degrees from each other along the longitudinal axis of debris collection assembly 100.

Referring to FIGS. 1 and 2, in a preferred embodiment, debris collection assembly 100 of the present invention comprises at least one panel member having a plurality of cooperating panel sections; in the "unfolded" or flattened configuration depicted in FIGS. 1 and 2, said cooperating panel sections are positioned in a single plane. Generally, said debris collection assembly 100 comprises base panel member 10 having central panel section 11 and first end 12, as well as first lateral panel section 20 and second lateral panel section 30. Said central panel section 11 is disposed between first lateral panel section 20 and second lateral panel section 30.

First lateral panel section 20 is connected to central panel section 11 along elongate folded crease 21, while second panel section 30 is similarly connected to panel section 10 along elongate folded crease 31. In a preferred embodiment, said elongate folded creases 21 and 31 are disposed in substantially parallel orientation relative to each other. Further, said elongate folded creases 21 and 31 permit first lateral panel section 20 and second lateral panel section 30, respectively, to move (that is, bend, fold or defect) out of a common plane with central panel section 11. Optional substantially triangular first lateral gusset section 22 is movably attached to first lateral panel section 20 along elongate folded crease 23, while optional substantially triangular second lateral gusset section 32 is movably attached to second lateral panel section 30 along elongate folded crease 33.

End panel member 50 generally comprises middle panel section 51, first lateral end panel section 60, substantially triangular end gusset section 61, second lateral end panel section 70 and substantially triangular end gusset section 71. Middle panel section 51 is movably connected to central panel section 11 along elongate folded crease 52. Said middle panel section 51 is also movably connected to end gusset section 61 along elongate folded crease 62, and to end gusset member 71 along elongate folded crease 72.

In a preferred embodiment, said elongate folded crease 52 is oriented substantially perpendicular to the longitudinal axis of central panel section 11, while optional elongate folded creases 62 and 72 are disposed in substantially parallel orientation relative to each other. First lateral end section 60 is movably attached to lateral gusset section 61 along elongate folded crease 63, but is not attached to first lateral gusset section 22. Second lateral end panel section 70 is movably connected to lateral gusset section 71 along elongate folded crease 73, but is not attached to second lateral gusset section 32.

In a preferred embodiment, said base panel member 10 and end panel member 50, including all lateral and gusset sections of said panel members 10 and 50, can be constructed of corrugated plastic material, cardboard or other material having desired characteristics. Said base panel member 10 and end panel member 50 can be beneficially lightweight, yet substantially rigid and capable of resisting unintentional deformation or bending, particularly in areas other than elongate folded creases.

Figure 3:
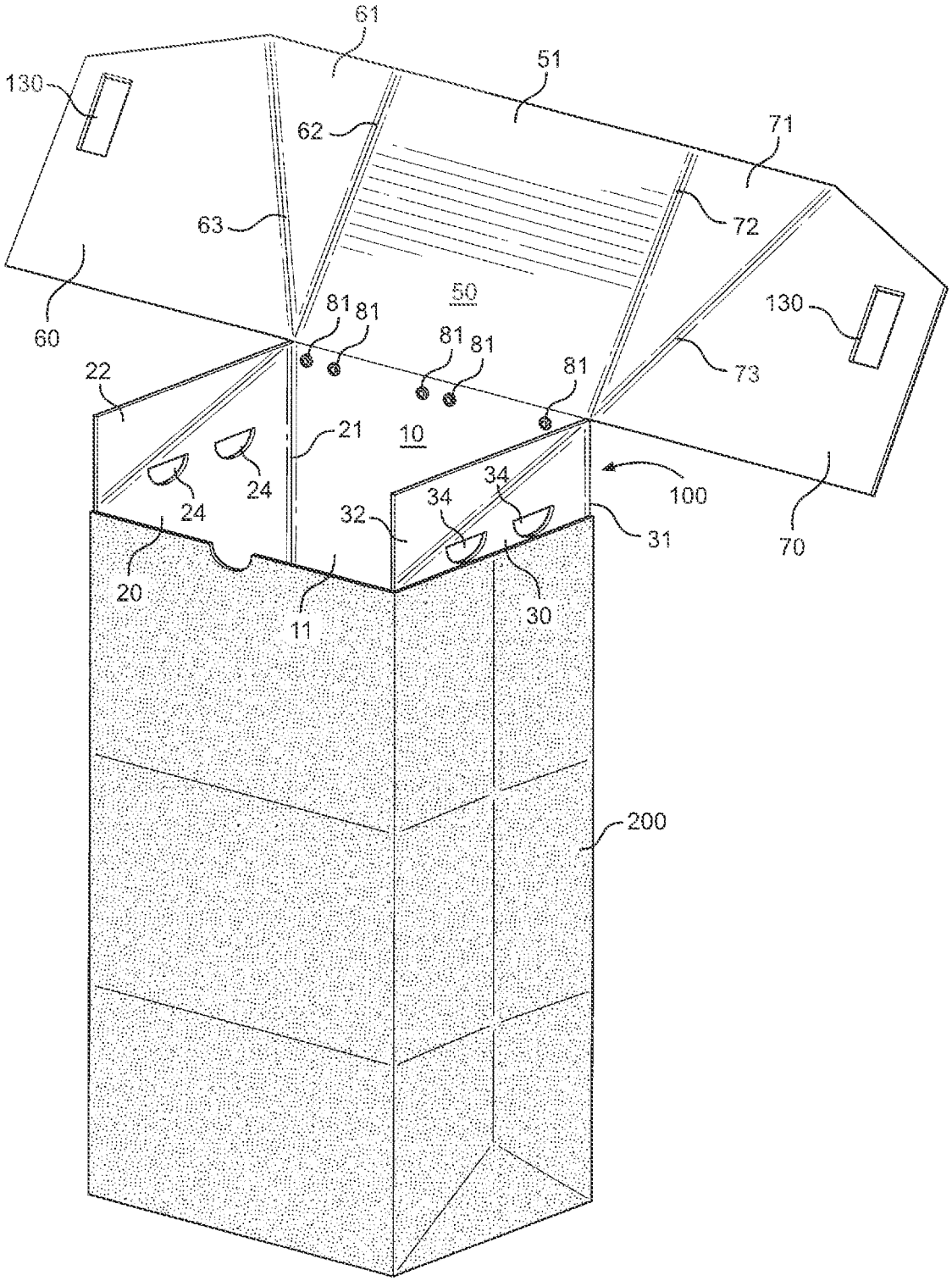
FIG. 3 depicts a side perspective view of a debris collection assembly of the present invention installed within a collection bag.

FIG. 3 depicts a side perspective view of debris collection assembly 100 of the present invention installed within a collection bag 200. Said collection bag 200 can comprise a conventional bag constructed from plastic material, cardboard or paper material, or any other desired material; although bags having many different shapes and sizes can be used without departing from the scope of the present invention, in a preferred embodiment the present invention can be beneficially utilized with conventional plastic and/or paper bags designed for the collection of yard debris for disposal or recycling purposes. In the illustrative example depicted in FIG. 3, bag 200 comprises a foldable paper bag designed for the collection of yard waste (such as, for example grass clippings, leaves or pine needles) and/or other loose debris.

Still referring to FIG. 3, base member 10 can be configured to create a chute apparatus formed by cooperating central panel section 11, first lateral panel section 20 and second lateral panel section 30. Specifically, first lateral panel section 20 can bend along elongate folded crease 21 until said panel section 20 is oriented at a substantially right angle to central panel section 11, while second panel section 30 can bend along folded crease 31 until said panel section 30 is oriented at a substantially right angle to central panel section 11. In this configuration, said first lateral panel section 20 and second lateral panel section 30 are oriented substantially parallel to each other, and substantially perpendicular to central panel 11.

Said chute apparatus formed by cooperating central panel section 11, first lateral panel section 20 and second lateral panel section 30 is at least partially received within bag 200. The substantially rigid and form-holding characteristics of said cooperating panel sections 11, 20 and 30 act to support and maintain bag 200 in an upright and substantially open position. As a result, when the configuration depicted in FIG. 3 is placed on substantially flat ground or otherwise stable underlying support surface, a user is not required to continuously hold bag 200 in an upright or open position.

End panel member 50, comprising middle panel section 51, first lateral end panel section 60, substantially triangular end gusset section 61, second lateral end panel section 70 and substantially triangular end gusset section 71, extends outwardly above the chute apparatus formed by panel sections 11, 20 and 30, as well as bag 200. In this configuration, said cooperating panel sections of end panel member 50 forms a funnel-like guide surface for directing yard waste or other loose debris into the chute apparatus formed by central panel section 11, first lateral panel section 20 and second lateral panel section 30 and, thus, into the interior portion of said bag 200. Similarly, although not required, optional lateral gusset sections 22 and 32 can be selectively flared outward relative to bag 200 to further serve as a guide surface for directing materials through the chute apparatus formed by central panel section 11, first lateral panel section 20 and second lateral panel section 30, and into bag 200. In this manner, debris collection assembly 100 facilitates quick, efficient and effective loading of yard waste or other loose debris into the interior portion of bag 200.

In a preferred embodiment, shaped apertures or openings 24 extend through first lateral panel section 20, while shaped apertures or openings 34 extend through second lateral panel section 30. As depicted in FIG. 3, said apertures 24 and 34 form hand grip(s) that enable a user to easily remove said chute apparatus (formed by central panel section 11, first lateral panel section 20 and second lateral panel section 30) from the interior of said bag 200 at any point in the loading process including, without limitation, when said bag 200 is fully loaded. Further, said chute apparatus can be removed from bag 200 without removing or dislodging any contents previously loaded into said bag 200.

Figure 4:
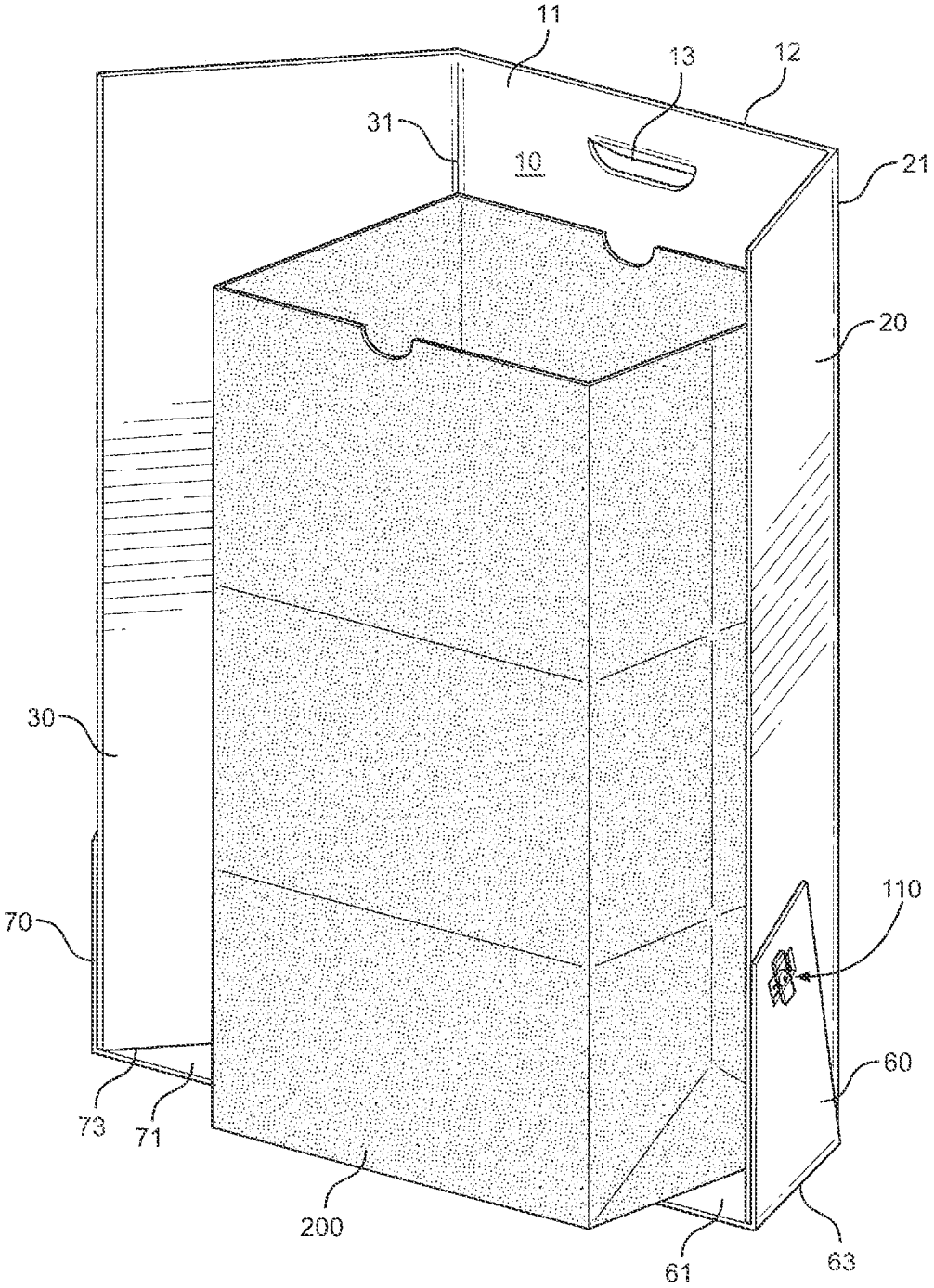
FIG. 4 depicts a front perspective view of a debris collection assembly of the present invention supporting a collection bag.

FIG. 4 depicts a front perspective view of reconfigured debris collection assembly 100 of the present invention supporting said collection bag 200. In a preferred embodiment, said debris collection assembly 100 can be selectively reconfigured—quickly, easily and without specialized tools or skills—to create a hauler apparatus formed by cooperating base panel member 10 and end panel member 50. Although said debris collection assembly 100 can be reconfigured at essentially any time, said debris collection assembly 100 is typically reconfigured to form a hauler apparatus after said chute apparatus configuration depicted in FIG. 3 has been utilized to load bag 200 with yard waste or other loose debris. Following removal of debris collection assembly from bag 200 and such reconfiguration, said hauler apparatus can be used to transport said bag, and any contents thereof, to a different (sometimes distant) location such as a predetermined collection point.

If said debris collection assembly 100 is configured as a chute apparatus to load yard waste or debris into bag 200 as depicted in FIG. 3, said debris collection assembly 100 can be removed from bag 200. Thereafter, end panel member 50 can be selectively attached to base panel member in order to form a recess or containment section for at least partially receiving bag 200.

Referring to FIG. 4, first lateral end panel section 60 is folded or bent along folded crease 63 until said lateral end panel section 60 contacts first lateral panel section 20; in this position, said lateral end panel 60 can be selectively secured to first lateral panel section 20 using fastener assembly 110 (discussed in more detail below). Similarly, second lateral end panel section 70 is folded or bent along folded crease 73 until said end panel section 70 contacts said second lateral panel section 30; in this position, said second lateral end panel 70 can be selectively, and temporarily or removably, secured to second lateral panel section 30. As depicted in FIG. 4, end gusset sections 61 and 71 (together with middle panel section 51, not visible in FIG. 4) form a base support surface; in this configuration, folded creases 62 and 72 are not folded or bent. Said support surface cooperates with first lateral panel section 20, central panel section 11 and second lateral panel section 30, to form a recess or receptacle for receiving bag 200, including any materials contained therein.

Following such reconfiguration as depicted in FIG. 4, said debris collection assembly 100 can be beneficially utilized as yard waste and debris hauler for transporting bag 200, as well as any contents, over desired distances. Additionally, in said hauler configuration depicted in FIG. 4, at least one aperture or opening 13 can be provided to define a hand grip, thereby allowing a user to easily grip and drag said debris collection assembly 100 and bag 200 to a desired location or other collection point.

More specifically, a previously loaded bag 200 can be moved onto said debris collection assembly 100, and said debris collection assembly 100 can then be tipped/tilted and dragged to a different location, such as a distant collection point. Referring back to FIG. 1, said debris collection assembly 100 further comprises at least one skid member 80. Although other positioning can be employed without departing from the scope of the present invention, in a preferred embodiment said at least one skid member 80 is attached to central panel section 11 using fasteners 81. Said at least one skid member 80 can be beneficially positioned to at least partially extend across folded crease 52.

Figure 5:
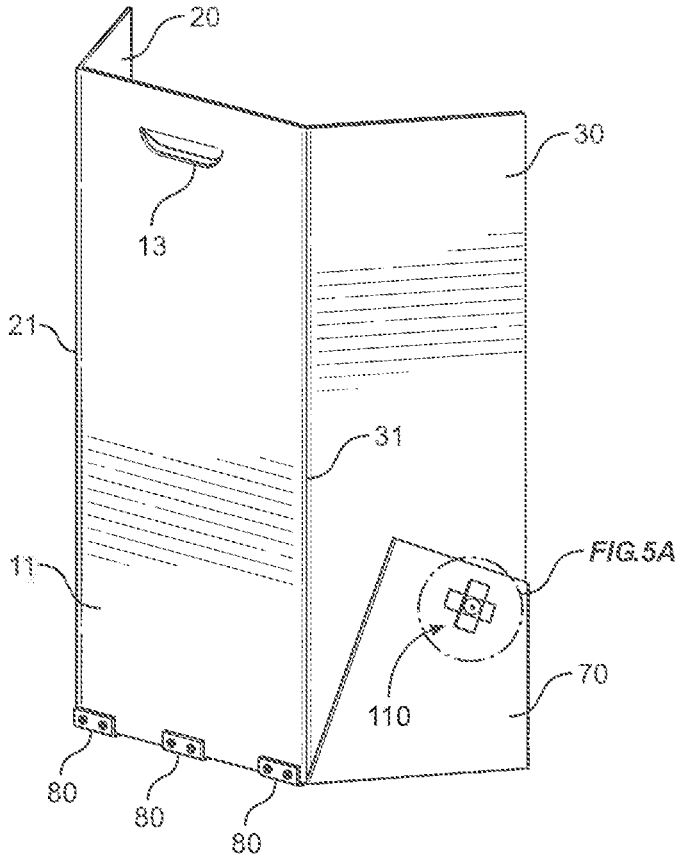
FIG. 5 depicts a rear perspective view of a debris collection assembly of the present invention.

FIG. 5 depicts a rear perspective view of debris collection assembly 100 of the present invention. When debris collection assembly 100 is configured as a hauler (as depicted in FIGS. 4 and 5), said at least one skid member 80 can contact the ground or other underlying surface, particularly when base panel member 10 is tipped or tilted from a vertical orientation. Said at least one skid member 80 can be manufactured from a substantially hard and/or wear-resistant material (such as, for example, rubber, plastic or other synthetic material). Said at least one skid member 80 provides strength and durability to said debris collection assembly 100 when used in said hauler configuration, and beneficially will not mark, damage or abrade an underlying surface (such as, for example, a driveway or road).

Referring to FIGS. 4 and 5, after bag 200 has been transported to a desired distant location or collection point, said loaded bag 200 can then be easily moved off of debris collection assembly 100. When not in use, said debris collection assembly 100 of the present invention can be quickly and easily reconfigured for convenient handling and storage. For example, when desired, said debris collection assembly 100 can be selectively reconfigured as depicted in FIGS. 1 and 2, such that base panel member 10 and end panel member 50, as well as all panel sections thereof, are positioned within a single plane. Similarly, debris collection assembly 100 can be further folded along one or more of its folded creases disclosed herein in order to further reduce the overall size of said debris collection assembly 100; by way of illustration, but not limitation, panel sections 20 and 60 can be folded onto panel sections 11 and 51, respectively, and then panel sections 30 and 70 can be folded onto (previously folded) panel sections 20 and 60.

Thus, said debris collection assembly 100 of the present invention can be alternatively and selectively configured to form: (i) a chute or bag holder (as depicted in FIG. 3) and/or (ii) a bag hauler (as depicted in FIGS. 4 and 5). Said attachment can be facilitated via a twist-turn lock, or other desirable and temporary attachment means, such as, for example, a pin and clip lock, a rope and wedge mechanism, a rope and spring clamp mechanism, a hook and loop fastener and/or cutting and folding said planar member(s) to form a locking mechanism. In a preferred embodiment, temporary fastener assembly 110 is employed to for this purpose.

Referring back to FIG. 1, said fastener assemblies generally comprise fastener clip members 120, each rotatably mounted to first lateral panel section 20 and second lateral panel section 30, using bolt 121. Each of said fastener clip members 120 can rotate about an axis extending through the longitudinal axis of bolt 121. In a preferred embodiment, fastener apertures 130 extend through lateral end panels 60 and 70, can have substantially the same shape as fastener clip members 120, and are sized slightly larger than said fastener clip members 120.

Figure 5A:
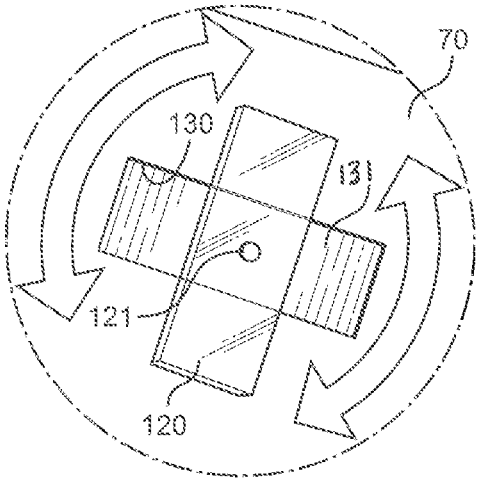
FIG. 5A depicts a detailed view of the highlighted portion of FIG. 5.
Figure 6:
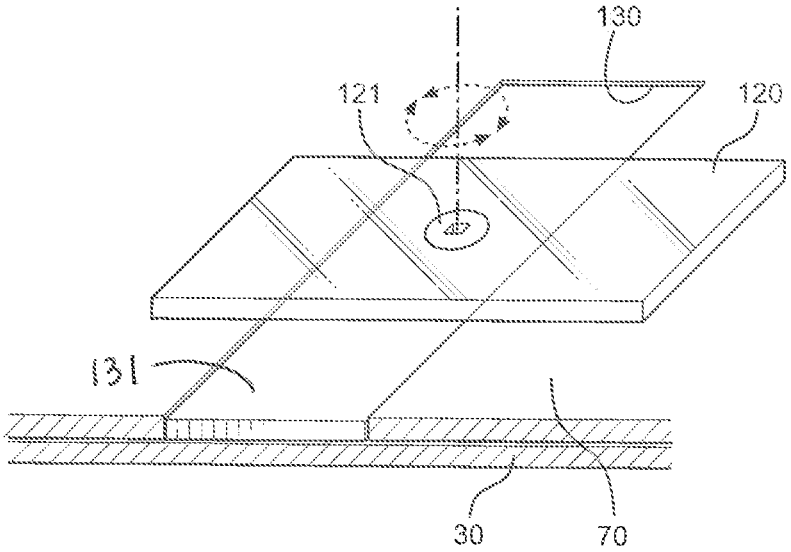
FIG. 6 depicts a perspective view of an adjustable locking assembly of the present invention.

FIG. 5A depicts a detailed view of the highlighted portion of FIG. 5, while FIG. 6 depicts a perspective view of an adjustable locking assembly 110 of the present invention. Second lateral end panel section 70 is folded or bent (along folded crease 73) until said end panel section 70 contacts said second lateral panel section 30. Fastener aperture 130 is aligned with fastener clip member 120; fastener spacer member 131 is disposed under said fastener clip member 120 and can be received within fastener aperture 130. Thereafter, said clip member 120 can be rotated about bolt 121. In a preferred embodiment, said clip member 120 is rotated until it is oriented substantially perpendicular to the longitudinal axis of fastener aperture 130, thereby contacting end panel section 70 and removably attaching said end panel section 70 to said second lateral panel section 30.

Figure 7:
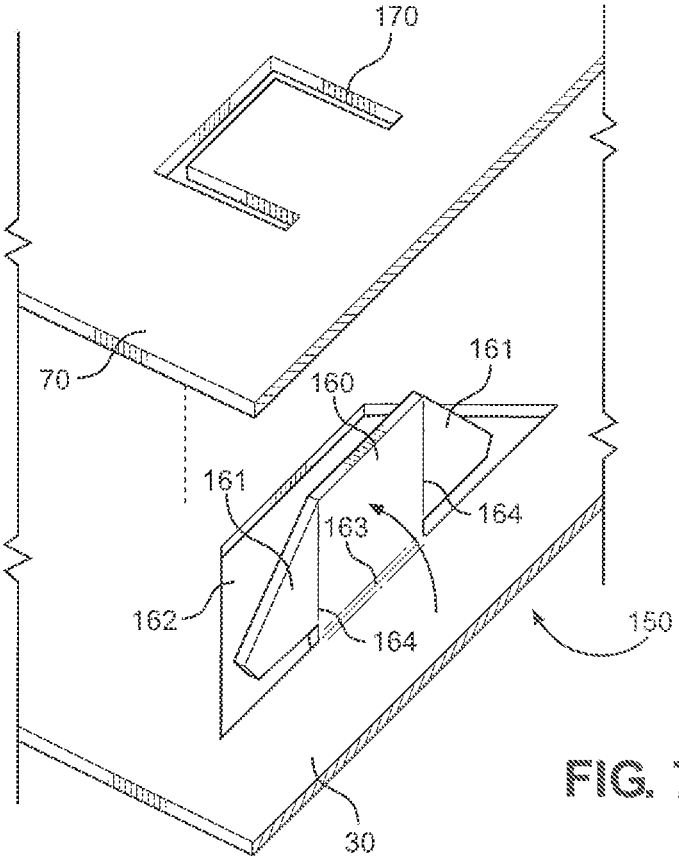
FIG. 7 depicts an overhead perspective view of a first alternative fastening assembly of the present invention in a first position.
Figure 8:
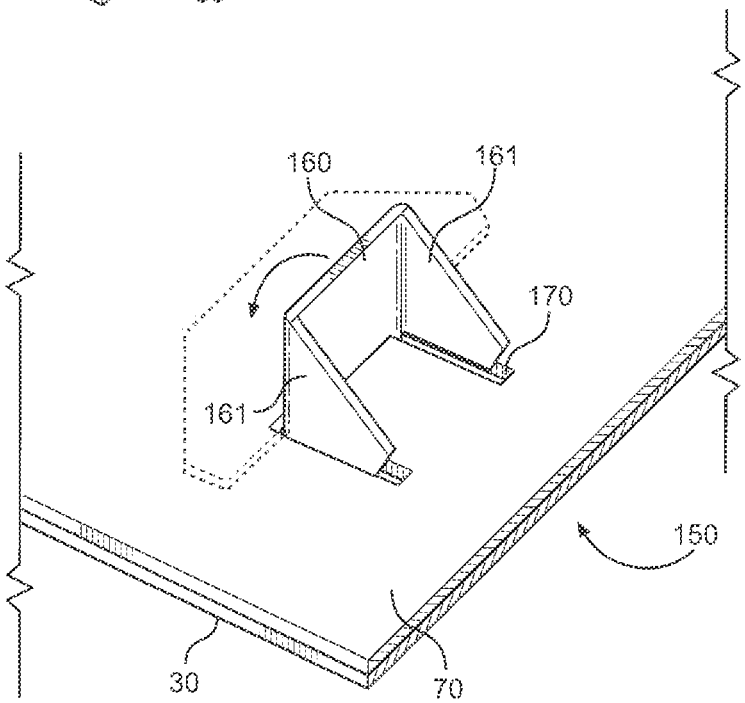
FIG. 8 depicts an overhead perspective view of a first alternative fastening assembly of the present invention in a second (engaged) position.

FIG. 7 depicts an overhead perspective view of a first alternative fastening assembly 150 of the present invention in a first position, while FIG. 8 depicts an overhead perspective view of said first alternative fastening assembly 150 of the present invention in a second (engaged) position. When sections 30 and 70 are not joined together or attached to each other, flap 160 can be received within recess 162; in this position, flap 160 (including, without limitation, lateral wing members 161 thereof) are configured within substantially the same plane as panel section 30.

When attachment is desired, flap 160 having lateral wing members 161 can be removed from recess 162 by bending said flap 160 upward and outward (from said recess 162) along folded crease 163. In this position, lateral wing members 161 can be then be bent into parallel relationship with each other along folded creases 164; in this configuration, said flap member 160 can be received within substantially U-shaped aperture 170 extending through panel member 70. If desired, lateral wing members 161 can be folded back into planar relationship along parallel folded creases 164, and folded down against panel section 70. In this manner, first alternative fastening assembly 150 can be used in order to selectively join section 70 with lateral section 30.

Figure 9:
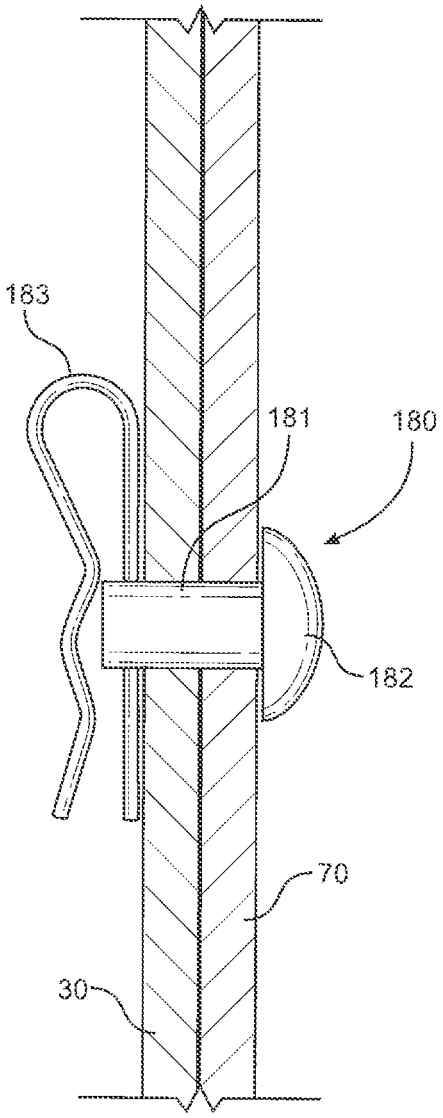
FIG. 9 depicts a side sectional view of a second alternative fastening assembly of the present invention.

FIG. 9 depicts a side sectional view of a second alternative fastening assembly 180 of the present invention. Bolt 181 extends through aligned bores in panel sections 30 and 70; head 182 of bolt 181 has a larger diameter than said aligned bores. Bolt 181 is secured in place and is prevented from falling out of said aligned bores in said panel sections 30 and 70 using cotter pin 183.

It is to be observed that elongate folded creases described herein (such as, for example, elongate folded creases 21, 23, 31, 33, 62, 63, 72 and 73) comprise folds in the panel material of base panel member 10 and end panel member 50. Alternatively, other means can be used for permitting deflection of said panel members relative to each other, such as hinges or the like, without departing from the scope of the present invention. Additionally, it is to be observed that gusset panel sections disclosed herein (and gusset sections 22 and 32, in particular) are optional and are not required for debris collection assembly 100 of the present invention to function, although said gusset panel sections can frequently improve performance and/or ease of use of said debris collection assembly 100.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A debris collection apparatus comprising:

a) a base member comprising:

(i) a central panel section having a top, a bottom, a first side and a second side;

(ii) a first lateral panel section foldably connected to said first side of said central panel section;

(iii) a second lateral panel section foldably connected to said second side of said central panel section;

b) an end member comprising:

(i) a middle panel section having a top, a bottom, a first side and a second side, wherein said bottom is foldably connected to said top of said central panel section of said base member;

(ii) a first wing panel section foldably connected to said first side of said middle panel section;

(iii) a second wing panel section foldably connected to said second side of said middle panel section;

(iv) a first substantially triangular gusset panel member disposed between said first wing panel section and said middle panel section;

(v) a second substantially triangular gusset panel member disposed between second wing panel section and said middle panel section;

c) a first fastener assembly configured to selectively attach said first wing panel section of said end panel section to said first lateral panel section of said base member; and d) a second fastener assembly configured to selectively attach said second wing panel section of said end panel section to said second lateral panel section of said base member; and e) at least one skid member;

wherein said debris collection assembly is configured to selectively alternate between a first chute arrangement and a second hauler arrangement, wherein said first chute arrangement is configured to be at least partially inserted into a debris collection bag, and said second hauler arrangement is configured to be pulled along the ground while supporting said bag, and wherein said at least one skid member is configured to contact the ground in said second hauler arrangement.

2. The debris collection assembly of claim 1, wherein said first wing panel section of said end panel section is not attached to said first lateral panel section of said base member; and said second wing panel section of said end panel section is not attached to said second lateral panel section of said base member, in said first chute arrangement.

3. The debris collection assembly of claim 1, wherein said first wing panel section of said end panel section is selectively attached to said first lateral panel section of said base member; and said second wing panel section of said end panel section is selectively attached to said second lateral panel section of said base member, in said second hauler arrangement.

4. The debris collection assembly of claim 1, further comprising a temporary fastener apparatus.

5. The debris collection assembly of claim 4, wherein said temporary fastener apparatus further comprises:

a) a first clip member rotatably attached to said first lateral panel section;

b) a first aperture extending through said first wing panel section and aligned with said first clip member;

c) a second clip member rotatably attached to said second lateral panel section; and d) a second aperture extending through said second wing panel section and aligned with said second clip member.

6. A method for collecting yard waste or other loose debris in a collection bag comprising:

a) configuring a debris collection apparatus in a chute arrangement, wherein said debris collection apparatus comprises:

i) a base member comprising:

aa) a central panel section having a top, a bottom, a first side and a second side;

bb) a first lateral panel section foldably connected to said first side of said central panel section;

cc) a second lateral panel section foldably connected to said second side of said central panel section;

ii) an end member comprising:

aa) a middle panel section having a top, a bottom, a first side and a second side, wherein said bottom is foldably connected to said top of said central panel section of said base member;

bb) a first wing panel section foldably connected to said first side of said middle panel section;

cc) a second wing panel section foldably connected to said second side of said middle panel section;

iii) a first fastener assembly configured to selectively attach said first wing panel section of said end panel section to said first lateral panel section of said base member;

iv) a second fastener assembly configured to selectively attach said second wing panel section of said end panel section to said second lateral panel section of said base member; and v) at least one skid member;

b) at least partially inserting said debris collection apparatus into a debris collection bag;

c) loading yard waste or other loose debris through said debris collection apparatus into said collection bag;

d) removing said debris collection apparatus from said debris collection bag;

e) reconfiguring said debris collection apparatus into a hauler arrangement, wherein said at least one skid member is configured to contact the ground in said hauler arrangement;

f) placing said loaded bag on said debris collection apparatus; and g) hauling said debris collection apparatus and loaded bag to a different location.

7. The method of claim 6, wherein said debris collection apparatus further comprises:

a) a first substantially triangular gusset panel member disposed between said first wing panel section and said middle panel section; and b) a second substantially triangular gusset panel member disposed between second wing panel section and said middle panel section.

8. The method of claim 6, wherein said debris collection apparatus comprises a temporary fastener apparatus.

9. The method of claim 8, wherein said temporary fastener apparatus further comprises:

a) first clip member rotatably attached to said first lateral panel section;

b) a first aperture extending through said first wing panel section and aligned with said first clip member;

c) a second clip member rotatably attached to said second lateral panel section; and d) a second aperture extending through said second wing panel section and aligned with said second clip member.

* * * * *